US008245873B2

(12) United States Patent
Steg

(10) Patent No.: US 8,245,873 B2
(45) Date of Patent: Aug. 21, 2012

(54) CONTAINER WITH SEALING LID RELEASIBLY FASTENED TO CONTAINER

(75) Inventor: Helge Steg, Stockholm (SE)

(73) Assignee: Arta Plast AB, Tyreso (SE)

( * ) Notice: Subject to any disclaimer, the term of this patent is extended or adjusted under 35 U.S.C. 154(b) by 78 days.

(21) Appl. No.: 12/497,173

(22) Filed: Jul. 2, 2009

(65) Prior Publication Data

US 2010/0140282 A1 Jun. 10, 2010

(30) Foreign Application Priority Data

Dec. 8, 2008 (EP) ..... 08021268

(51) Int. Cl.
*B65D 41/16* (2006.01)
*B65D 5/64* (2006.01)

(52) U.S. Cl. ..... 220/780; 220/359.1; 220/359.4; 220/657; 229/5.5

(58) Field of Classification Search ..... 215/274, 215/232; 220/657, 780, 656, 659, 359.1, 220/359.4, 699, 700, 694; 229/5.5, 5.7
See application file for complete search history.

(56) References Cited

U.S. PATENT DOCUMENTS 4,418,834 A 12/1983 Helms et al.
4,442,971 A 4/1984 Helms
5,647,501 A 7/1997 Helms
5,911,334 A * 6/1999 Helms ..... 220/359.4
7,086,545 B2 * 8/2006 Mannion et al. ..... 211/181.1
2006/0186120 A1 8/2006 Steg

FOREIGN PATENT DOCUMENTS

EP 1475314 A1 11/2004
EP 1693309 A1 8/2006
FR 2212220 7/1974

OTHER PUBLICATIONS

Search Report of European Patent Office regarding European Patent Application No. 08021268.1-2308, May 26, 2009.
Examination Report of New Zealand Intellectual Property Office regarding New Zealand Patent Application No. 578263, Feb. 11, 2010.
Examination Report of New Zealand Intellectual Property Office regarding New Zealand Patent Application No. 578263, Jul. 13, 2009.

* cited by examiner

*Primary Examiner* — Robin Hylton
(74) *Attorney, Agent, or Firm* — Bacon & Thomas, PLLC

(57) ABSTRACT

A container (10) for solid or pasty products, as well as for those that are flowable or can be removed by dipping, in particular food products, includes a lower container part (11) for receiving the product, as well as an upper container part (12) embodied as a container lid, wherein the lower container part (11) has a continuous rim (15) extending around its container opening (12), wherein the upper container part (12) consists of a collar element (16), which extends around the container opening (14) and encloses it in a collar-like manner, and of a substantially flat lid element (17). The lid element (17) is fastened on the collar element (16) and is releasably fastened on the rim (15) of the lower container part (11). The collar element (16) has a circumferential wall (161), oriented with its free end toward the lid element (17), on which the lid element (17) is fastened.

14 Claims, 3 Drawing Sheets

CONTAINER WITH SEALING LID RELEASIBLY FASTENED TO CONTAINER

BACKGROUND

A. Field

The invention relates to a container for solid or pasty products, as well as for those that are flowable or can be removed by dipping, in particular food products, comprising a lower container part for receiving the product, as well as an upper container part embodied as a container lid, wherein the lower container part has a continuous rim extending around its container opening and wherein the upper container part consists of a collar element, which extends around the container opening and encloses it in a collar-like manner, and of a substantially flat lid element, and is releasably fastened on the rim of the lower container part.

B. Related Art

A container of this type is known from EP-A-1 693 309.

As a rule, it generally applies that such containers are made of a plastic material and, as a rule, are produced by means of known injection molding technology. Containers of this or similar types are commercially available in most different sizes and are employed in most different shapes for all possible products which must be packaged in a sanitary, or respectively germ-free manner. Products, for example contained in such containers as their packaging unit, and offered in grocery stores are, for example dairy products of all types, meat and sausage products, but also vegetable and fruit products, as well as finished products in a refrigerated or non-refrigerated form.

Since the containers in accordance with this type are mass-produced and are intended to contain the products described above by way of example in a sanitary, germ-free and airtight manner, it must be possible to produce them in a cost-efficient manner in order to be accepted in the market place, i.e. on the one hand by the makers of the products, and on the other by their consumers. Furthermore, in compliance with special legal regulations, such containers must show, as completely as possible, information regarding their contents, the composition of the products, the nutritional contents of the products, as well as information regarding the date of production and the expiration date, as well as definite information, furthermore legally required in certain countries, regarding the compatibility with health regulations of the products in the container, and the like.

For this reason, such containers are as a rule provided with special labels providing such information and the respective parameters regarding the product to the consumer. In many cases, the name of the manufacturer, certain legally protected trademarks, and the like, are contained on the label, and as a rule, in the case of many of these products sold in such containers, the product itself is pictured, for example the sausage product, the cheese product, or a product in the form of a paté or the like.

The separate labels have the disadvantage that they make the production of the container considerably more expensive since, following the filling of the container with the product and closing of the container, the label must be placed either on the container itself, the lower container part, or possibly on the container lid and the actual container.

A further serious problem in connection with such containers lies in that in the course of opening the container by lifting the lid which, in the generally known yoghurt and cottage cheese containers, is merely constituted by an aluminum foil, the lid is not torn off at the actual locations in the rim area provided for this, but that instead the actual lid tears, so that in that case the opened container can no longer be closed even temporarily, if the product stored in the container has not been completely removed, or respectively used up. With another type of a closure for such containers, in which a foil imprinted in the manner described above has been glued to the actual lid, an attempt to open it shows the very serious disadvantage that the foil is separated from the actual container lid, i.e. is torn off it, without the connection of the container lid with the actual container being released, i.e. the container cannot be opened, which, however, is the actual goal.

A third variation of containers is known in which a lid, produced in the course of the manufacture of the container lid in accordance with the method of the so-called "immolded label (IML)", is already connected in the injection mold with the foil constituting the exterior closure of the container lid, and a rim area of the foil extending past the container lid is connected with the container.

Such containers have the serious disadvantage that the label, or respectively the foil, which are not reinforced in the rim area of the container lid, are uncontrollably torn off or ripped in the course of opening the container, and furthermore that, because of the notch effect between the foil and the container lid during tearing off, the foil is uncontrollably torn off the container lid in spite of the use of the "immolded label" technology, and the container can only be opened by using an extraneous tool, such as scissors, or respectively a knife. It is obvious that a lid opened in this way is no longer capable of closing the container opening even in a makeshift manner in case the product in the container has not yet been completely removed.

A further substantial disadvantage is that in many cases the soiling of the surroundings, or respectively of the consumer or of the user who wants to open a container embodied in this way, is the result.

A container is known based on EP-A-1-475 314 of the same applicant, in which the disadvantages mentioned above in connection with containers up to now and with container lids have been avoided in a very elegant and efficient manner.

The use of the container of the same applicant for various container contents for mass use, and therefore for mass production, requires very cost-efficient solutions for producing such containers, see above, in which case it is intended to reduce the costs still further, also in regard to the container of the kind mentioned at the outset.

A substantial factor driving the costs are the high manufacturing expenses for the tools for the injection molds for manufacturing the previously described containers, in particular also the container in accordance with this type. It is possible to state with some exceptions that the lower the manufacturing expenses of injection molds, or respectively tools, the simpler the products produced with them seem to be. The term "simplicity" in connection with the manufactured end product should be understood in such a way that these can be produced in continuously fewer process steps, but can nevertheless constitute a highly complex, but very efficient end product at the end of production. Thus it is attempted to make a very simple manufacturing tool available, by means of which it is possible to produce in a simple manner a possibly highly complex, highly effective end product, in this case a container in accordance with the type discussed herein.

Although in principle this goal has been achieved with this kind of container, with containers of this type the requirement for cost efficiency in their manufacture continues to exist. As mentioned at the outset, these containers are as a rule one-way products which, after having been manufactured, filled with food, and following the consumption of this food in this container, are then disposed of as empty containers, i.e. they are either thrown into the household trash, or they are returned in the form of raw material from which they were produced into the raw material cycle.

Besides the production of the containers, i.e. the manufacturing steps of the containers, consisting of the upper container part and the lower container part embodied in accordance with the type of container, the manufacturing of the injection molding tool is a very cost-intensive factor, see above, which is a direct part of the final manufacturing cost of these containers, depending on the number of containers to be produced by it. It is possible to make the rough statement that the simpler the injection molding tool is designed, the lower is its manufacturing cost, and the simpler the injection molding tool is designed, the simpler the process steps can as a rule be performed by means of the tool, in order to form the complete container, in particular the upper container part (the lid), and the faster the container, or respectively its components, can be produced.

BRIEF SUMMARY OF THE INVENTION

It is therefore the object of the present invention to create a container of the type mentioned at the outset, which can be manufactured even faster and more easily than the containers in accordance with the containers discussed above, and which, in comparison with containers of this kind, requires even fewer process steps for its manufacture, so that its manufacturing costs can be reduced, while the very good properties of the containers of this type are to be maintained without restrictions, for example in that the closing properties after the first opening for the intended use of the contents of the container guarantee exceptionally good closure properties during the subsequent closing of the container, and that in principle it can be reclosed and opened again as often as desired after the first opening, without the sealing properties between the upper container part, or respectively the lid, and the lower container, part being reduced.

This object is attained in accordance with the invention in that a collar element of the container lid has a circumferential projection face, oriented with its free end facing toward the lid element, and on which the lid element is fastened.

As intended, the advantage of the solution in accordance with the invention lies substantially in that the actual flat-shaped lid element is also of one piece here, and it, together with the circumferential collar element which also constitutes a mechanical support for securing the stability of the shape of the lid element, can again dependably enclose the lower container part, i.e. the contents of the container, in which case it is possible by reason of the fastening of the lid element on the projection face oriented toward the lid element and embodied at the free end of the collar element to provide an embodiment of the fastening of the lid element on the collar element, which permits the manufacture of the collar element and of the lid element in one step, so to speak.

A further substantial advantage of this offered attainment of the object of the invention essentially consists in that the injection molding tool can be structurally designed in such a way that fastening can be realized, as intended, in one production step, so to speak, with the production of the collar element, or possibly also in one production step with the manufacture of the lid, in which case it is also possible in accordance with the invention to produce the collar element, lid element and fastening in a single work step in a structurally appropriately designed injection molding tool.

Yet, consistent with the result obtained in accordance with containers of this kind, by means of the invention the principle is used that the flat lid element required for receiving visually recognizable information can here in accordance with the invention perform both the functions of the actual lid element as well as the functions of the information carrier displaying the visual information.

In accordance with a very advantageous embodiment of the container, the rim of the lower container part is embodied, at least in part, in the manner of a circumferential flange, i.e. it is in fact possible to employ lower container parts for realizing the container in accordance with the invention such as are generally known in connection with the most basic containers, for example the known so-called yoghurt containers and their variations. Therefore the lower container part can be very simply designed without the ability of the container to function being negatively affected, i.e. the previously described cooperation between the upper container part and the lower container part.

In connection with the embodiment of the circumferential flange of the lower container part around the opening of the lower container part, it is particularly advantageous to embody the rim extending around the opening of the lower container part in relation to the imagined resting of the lower container part on a base extending substantially parallel with the base, i.e. to always retain this reference value—base—for embodying the circumferential flange, independently of the cross-sectional shape of the actual lower container part. It is known that such containers, or respectively lower container parts, can have any arbitrary cross-sectional shapes per se, for example trapezoidal, or with any arbitrary number of corners, bottle-shaped, but also cup-shaped. Advantageously the flange is always embodied parallel with a plane of reference, namely the base in this case.

In accordance with a further advantageous embodiment of the container, the lid element is fastened to the rim in such a way that it covers it, at least partially, i.e. depending on the material for the lid element, and/or depending on the material for the lower container part, and/or depending on a material which provides the fastening of the lid element on the rim, the width of the fastening of the lid element on the rim can be selected as required, in which case the choice of the actual fastening width on the rim is selected as a function of the size of the container. Foodstuff products of low weight, which are received in the container, do not require the same width of the fastening as products of great weight.

In connection with another advantageous embodiment of the container, the lid element is fastened to the inside of the projecting surface, which has the advantage that the manufacture of the connection between the lid element and the rim element can take place in a single manufacturing process, so to speak, since in case the elements are made of injectionable plastic, the plastic needs to be injected into the injection mold only from one side. But this embodiment of the invention also has the advantage that the fastening, or respectively the area of the fastening between the lid element and the rim, is not visible from the outside, i.e. a visual protection and also a mechanical protection exists, because the lid element is then protected against being "torn open, or respectively torn off".

In accordance with a further embodiment, the lid element can preferably also be fastened on the outside on the projecting surface, which for example would be desirable in case of an alternative possibility of fastening, in which the surface of the lid element which is visible from the outside is intended to be made as large as possible, because for certain purposes it is intended to place as much information as required for the consumer on the lid element, for example visible from the outside. In this case the rim areas of the lid element, on which the connection with the collar element takes place, can be used in their entirety for imprinting and the like.

In accordance with a further very advantageous embodiment form of the container, the lid element itself is made of a foil-like body, in which case it can also be advantageous to embody the lid element in one piece with the circumferential collar element which, for example, can be technically realized in that it is possible to produce the entire upper container part in a single injection molding step in a single suitable injection mold, in which case the application of the visual information regarding the contents of the container, as well as other information, which can be seen by the observer on the exterior, can simultaneously take place in the course of the production of the upper container part in accordance with the already mentioned method of "immolded label (IML)".

However, it is also advantageously possible to form the lid element and the collar element as separate parts, which are connected with each other by means of a suitable connecting technology, for example by welding and/or adhesion. Although this design of the upper container part, i.e. with an originally separately manufactured lid element and separately manufactured collar element, entails greater cost, but this design, possibly on the basis of external given values, enables one to use different materials for the embodiment of the collar element on the one hand, and on the other for the embodiment of the lid element.

Preferably the rim of the container is designed in one piece with the container itself i.e. when the manufacturing process using this design of the container is finished, for example when it is produced in an injection mold, the container is embodied with a rim and is completely finished. However, in principle it is also possible to form the rim, or respectively the rim area of the lower container part, as a separate element, and the lower container part also as a separate element, and then to connect the rim element extending around the container opening with the lower container element itself. Such solutions are advantageous if the material of the actual lower container part is not easily suitable for forming the connection between the rim of the container and the lid element, for example. In this embodiment the container element, for example, can be made of a suitably sturdy material, such as paper and/or on a cardboard basis, while the separate rim area can for example consist of plastic, which again can be suitably connected with the lid element, or respectively used with it, for example by welding, use of an adhesive, ultrasound welding, or simply by connecting the material of the lid element and the material of the rim element itself.

The thickness of the flat lid element can be selected as a function of the container size, the contents of the container, the product to be received in the container, as well as a function of the material used for making the container, in different ways over a wide range, i.e. it can be matched directly to the packaging job to be respectively accomplished by means of the container. However, to keep the amount of the material required for forming the lid element as low as possible and, if required, to keep the lid element transparent to visible light, it is advantageous to keep the thickness of the lid element within a range of between 0.1 and 0.3 mm.

For producing the flat lid element and/or for producing the collar element and/or for producing the lower container part and/or for producing the separate rim area in case the lower container part requires such a different rim area, preferably a plastic material capable of being injection-molded, for example polypropylene, is used, while, however, other suitable plastic materials capable of injection molding can also be employed, provided they are neutral in regard to the product to be placed into the container, i.e. that they do not affect it in its consistency, its flavor and the like.

As mentioned, the material of the lid element can advantageously be selected to be such that it is at least transparent to light in the visible range of the light, which has the very large advantage that in that case the material received in the container can be observed, or respectively recognized, in the closed state of the container.

The collar element itself advantageously has an area designed in the manner of a snap-in connection, which extends in a releasably snapped-in manner behind the rim extending around the container opening. Only the mechanically sturdily embodied, substantially dimensionally stable collar element takes part in this releasable connection of the upper container part on, or respectively with the lower container part, i.e. the amount of material required for producing the upper container part can be directly limited to the formation of the collar element, while the actual lid element can be embodied in accordance with its purpose so thin, i.e. foil-like, that it is sufficient for providing its hermetic closure function of the lower container part, or respectively of the product received in the lower container part.

Finally, it is a great advantage if the area of the collar element has a protrusion directed toward the rim of the lower container part and embodied substantially triangular which, in the closed state of the container, extends underneath the rim. By means of a snap-in connection between the upper container part and the lower container part embodied in this way a closure is formed, which assures a secure connection and seals hermetically and provides a continuously assured safe mechanical closure and tightness for preventing the introduction of germs from the exterior into the container interior, even in case of multiple opening and closing of the container.

It is extraordinary advantageous to design the container in such a way that, for removing the upper container part consisting of the collar element and the lid element, the connection between the lid element and the rim is designed to be releasable, while the connection between lid element and the collar remains fixed. The connection between the lid element and the circumferential rim of the lower container part, on the one hand, and the connection, or respectively fastening, of the lid element and the collar element are differently designed in respect to the degree of the sturdiness of their connection, so that the connection between the collar element and the lid element is maintained, even after repeated opening of the container, while the connection between the lid element and the circumferential rim of the container always remains disconnected, or released, after the first, or respectively initial release.

DESCRIPTION OF THE DRAWINGS

The invention will now be described in detail by means of an exemplary embodiment, making reference to the following schematic drawings. Shown in these are in.

DETAILED DESCRIPTION OF PREFERRED EMBODIMENTS OF THE INVENTION

Figure 1:
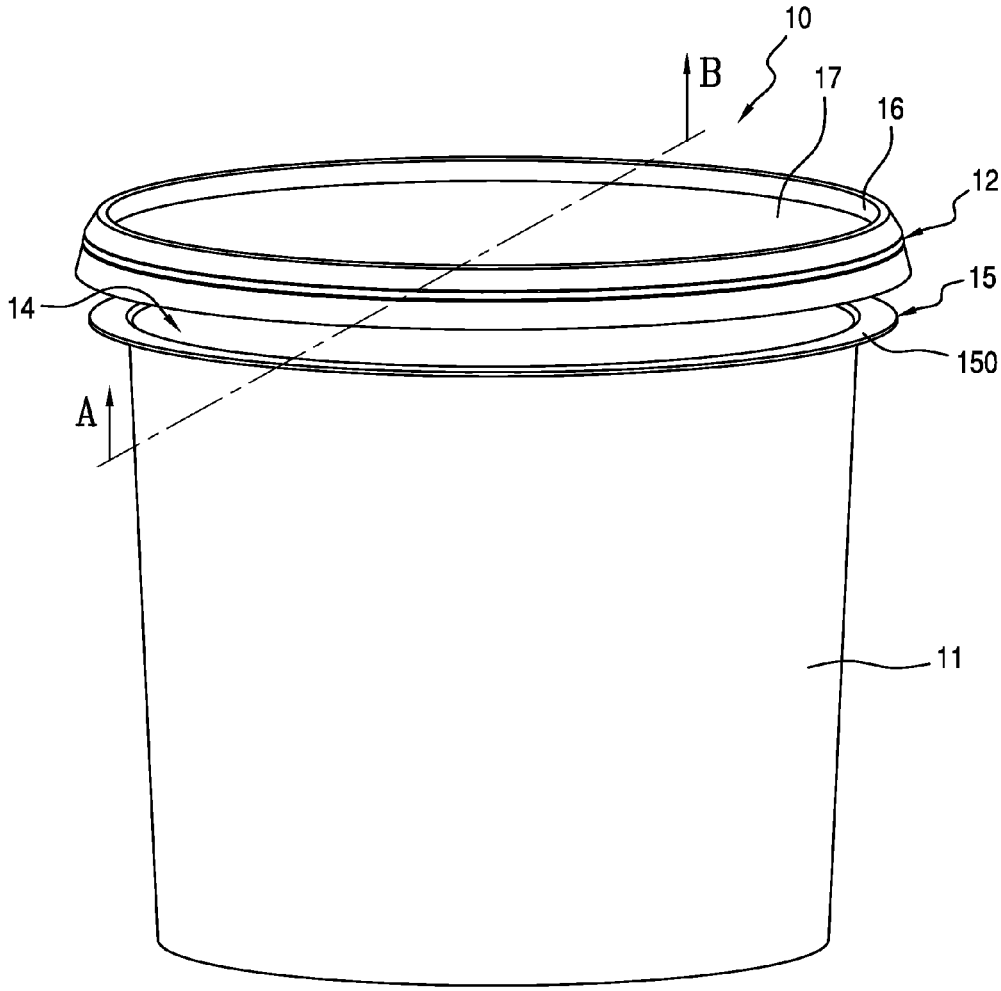
FIG. 1, in a perspective representation a container typical of the invention, consisting of a lower container part and an upper container part, wherein here, for reasons of representation, the upper container part is represented separated from the lower container part, i.e. slightly raised.

It should be noted at the start that the represented drawing figures do not constitute any limitation of the container in accordance with the invention in regard to structural specifications individually represented in the drawing figures. Instead, all elements and structural specifications represented in the drawing figures are a part of the invention without any limitations, even if at present they are not expressly set out, or respectively claimed in the patent claims.

Figure 2:
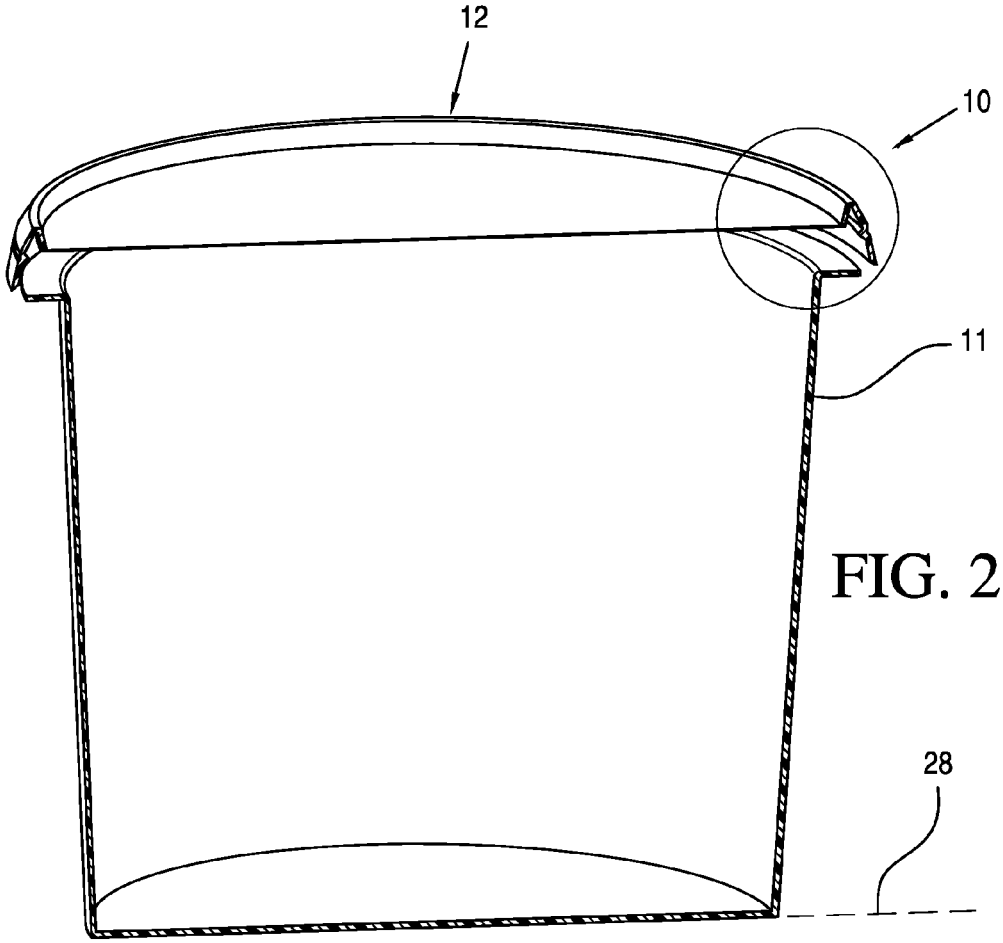
FIG. 2, is a representation in accordance with FIG. 1, but in section along the lines A-B in FIG. 1, FIG. 3, is a detail of the rim area in FIG. 2, and FIG. 4, is an enlarged scale a portion of the rim area in accordance with FIGS. 1 to 3 in a lateral view and in section, with the upper container part placed on the lower container part and with the lid element connected with the former.
Figure 3:
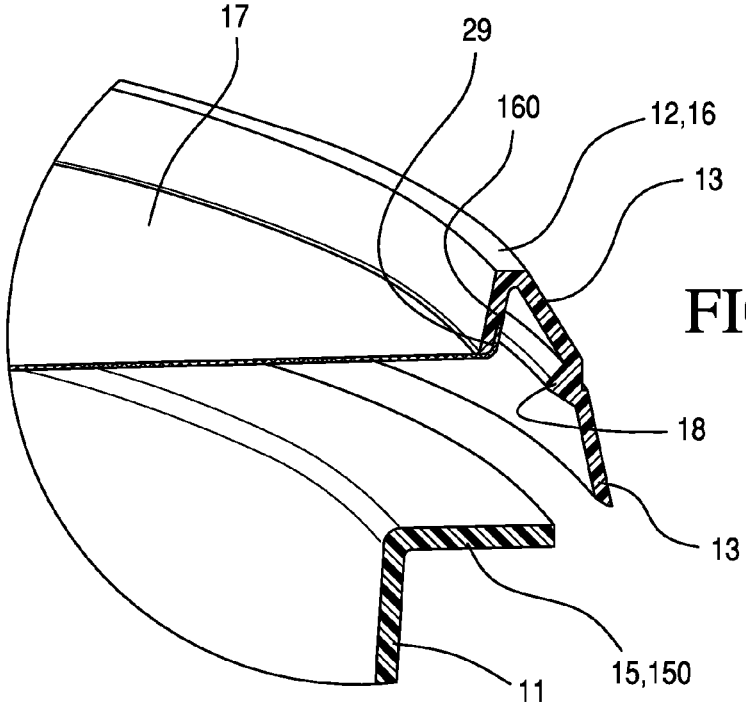

The container 10 as it is shown in its entirety in FIG. 1, and in FIG. 2 in partial section, is used for receiving solid, pasty products, as well as those which are flowable or can be dipped out, in particular food products. However, the container 10 can also be used for the germ-free storage of medical instruments, or also in the field of medical appliances, such as bandages or other, medically employed small parts. In the closed state, following the filling of the container 10 with the desired products and subsequent hermetic closing, a germ-free storage of the products received in the container 10 is assured.

The container is comprised of a lower container part for receiving the actual product. The lower container part 11 has a container opening 14, which is closed off by the upper container part 12, see in particular FIGS. 1 and 2.

The lower container part 11 has a rim 15 extending around the container opening 14, which here in the representations in FIGS. 1 and 2 extends away, substantially at right angles, from the lateral walls of the lower container part 11. Because the shape of the container 10, or respectively of the lower container part in particular, can be per se designed in any desired way, the embodiment and orientation of the rim is better characterized by saying that, in relation to an imaginary seating of the lower container part on a base 28, the circumferential rim 15 of the lower container part 11, is substantially embodied parallel to the base 28, as indicated by the dashed line 28 in FIG. 2, which represents an imaginary base. It should be pointed out that in no way can the lower container part 11 only have the shape with a circular cross section represented in the drawing figures, but instead any desired other shape, for example with a cube-shaped cross section or oval cross section, or the like.

It applies in principle that, different from the representation in the drawing figures in which it is designed in a single part, the lower container part 11 can also be embodied in several parts, for example in the form of a separate part, which can extend around the rim 15, or respectively the upper flange 150 constituted by the rim 15, and can be connected with the remaining portion of the lower container part 11 in a manner not shown. In other words, this means that the lower container part 11 can basically consist of several parts.

Since containers 10 of this type are otherwise known, reference will be made in what follows only to the structural embodiment of the lower container part 11 in connection with the structural specifications in accordance with the invention.

Furthermore, the container 10 is comprised of the already mentioned lower container part 11 and an upper container part 12, i.e. the actual container lid or cover. The upper container part 12, or respectively the container lid or cover, consists of a collar element 16, such as can be seen in FIGS. 1 to 4, and in this connection reference is also made to the detailed representations in accordance with FIGS. 3 and 4. The upper container part 12 also comprises a substantially flat lid element 17, which can also be recognized in FIGS. 1 to 4. In comparison with the other walls of the lower container part 11 and of the collar element, the flat lid element 17 is embodied very much thinner, which will be described in detail further down below.

The collar element 16 is embodied in such a way that it extends around the container opening 14 as a one-piece molded part, i.e. it encloses it in a collar-like manner, again see FIGS. 1 and 2 in particular, for example. The collar element 16 constitutes a frame, so to speak, which encloses the flat lid element 17. The collar element 16 substantially has two areas, namely a strip-like area 19, which in the drawing figures here points away substantially at an acute angle in relation to the rim 15 of the lower container part 11, and a projection or wall 162, wherein the projection or wall 162 is again embodied in one piece with the strip-like area 19 at an acute angle. The projection or wall 162 constitutes a projection or wall face 161, both on its inner side (inside) and on its outer side (outside) as shown in the drawings. The area 19 constitutes a part of a snap-in connection 18, and the rim 15, or respectively the circumferential rim 150 of the lower container part 11, constitutes a further part of a snap-in connection 18, so that both parts form a mutual snap-in connection 18 in such a way, that the rim 15, or respectively the circumferential rim 150, and the projection part 180 oriented toward the lower container part 11 in the area 19 of the snap-in connection 18, extend one behind the other in a snapped-in manner.

The free or lower end 160 of the projection or wall 162, which functions as a part of the collar element 16, points toward the lid element 17. The actual lid element 17, which is a part of the upper container part 12, is fastened at the inside of projection or wall face 161 formed on the free end of the collar element 16. As already indicated, the lid element 17 consists of a foil-like body of a thickness in the range of between 0.1 and 0.3 mm, for example. In a preferred embodiment of the container 10, the lid element 17, i.e. the foil-like body, can be designed in one piece, i.e. integrally, with the collar element 16. Such a design of the container 10, or respectively of the upper container part 12, can be produced in a single injection molding process.

However, it is also possible to produce the lid element in the shape of the foil-like body separately and to connect its outer edge with the circumferential collar element 16, for example by means of welding and/or an adhesive. In this case the projection face or circumferential wall 161 of the collar element which, as already stated, is embodied at the free end 160 of the circumferential wall, can have a circumferential depression corresponding to the thickness 24 of the lid element 17, which is clearly visible in the enlarged representation in FIG. 4. In this depressed area of the wall 161, "on the inside" in the representation of the drawing figures, i.e. in the imagined space of nearly triangular cross section, such as appears "on the inside" in the closed state of the container 10, i.e. with the upper container part 12 placed on the lower container part 11, the outer edge of the lid element 17 can be connected with the depressed area of the wall 161, either by means of the said welding and/or adhesive connection, or a direct connection of the two materials. However, it is also possible here, to fasten the lid element 17 on the "outside" of the projection face or wall 161 with the free end of the projection face or wall facing the rim 15, for example, with a depression to be provided in the projection face 167 if desired, as shown in FIG. 4A.

Figure 4:
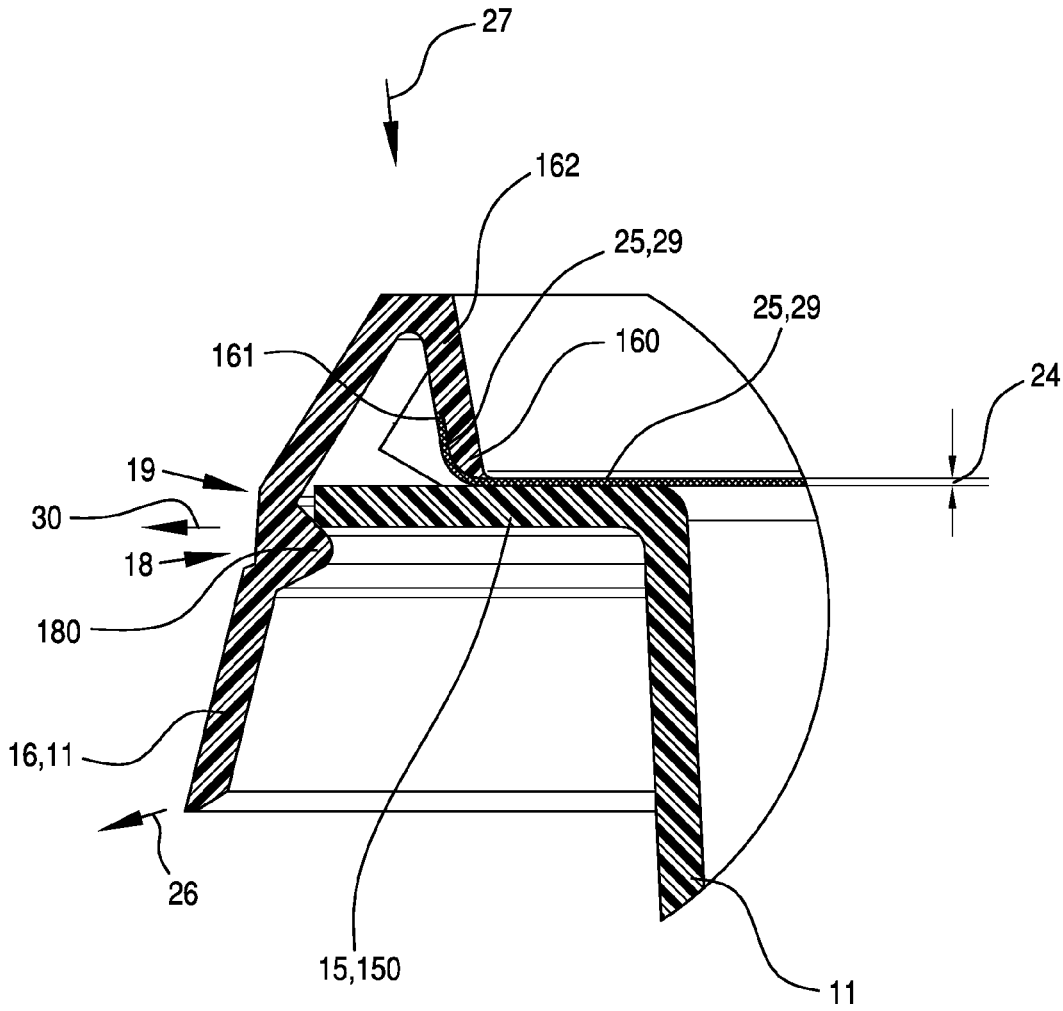
FIG. 4A is a detail view showing an alternate example of the attachment of the lid to the collar element.
Figure 4A:
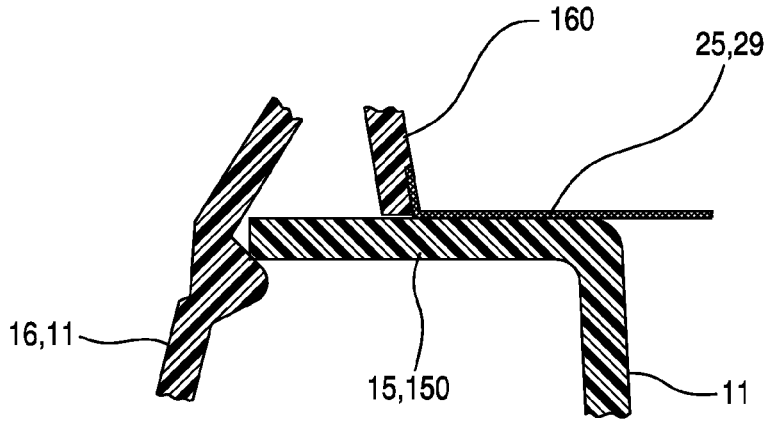

The lid element 17 rests on the circumferential rim, or respectively the circumferential flange, of the lower container part 11, connected with the collar element 16 in the above described way, see FIG. 4, namely when the container 10 is closed, i.e. the upper container part 12 has been placed on the lower container part 11, such as represented in FIG. 4.

After the lower container part 1 and the upper container part 12 have been produced in the above described manner, the lower container part 11 is filled with the product by the manufacturer of the product with which the container 10 is to be filled. Subsequently the upper container part 12 is placed on the lower container part 11 and they are moved toward each other in such a way, that the said snap-in connection 18 between the rim 15, or respectively the free end of the circumferential flange 150 of the lower container part 111 and the projection 180 applied to the "inside" in the area 190 of the snap-on connection 18 of the upper container part 12, or respectively the collar element, snap together, snapping-in taking place in the direction of the arrow 30 because of a slight elastic deformation of the collar element 16, see FIG. 4. Once the lid element 17 rests on the rim 15, or respectively the circumferential flange 150, the free end 160 of the collar element 16 rests via the interposed lid element 17 also on the rim 15, or respectively the circumferential flange 150, at least in the design of the container 10 represented here, see FIG. 4.

Following this, the lid element 17 resting on the rim 15, i.e. covering it at least partially, is fastened on the latter, this by gluing and/or welding and/or by means of other suitable connecting technologies, or respectively connecting means.

Filling of the lower container part 11, as well as the subsequent welding of the lid element 17 with the rim 15, or respectively the circumferential flange 150, can take place in a vacuum.

For removing the upper container part 12 from the lower container part 11, the user can insert his fingers under the free end of the collar element 16, in the drawing figures the "downward directed" free end of the upper container part, pulling in the direction of the arrow 26.

Since the material used for forming the lower container part 11 and the upper container part 12 which, for example, can be a suitable material capable of being injection molded, for example propylene, is elastic, it is possible to cause an elastic deformation of the free end of the collar 16 in the direction of the arrow 26, so that it comes out of engagement with the free end of the circumferential flange 150 of the rim 15 of the lower container part 11, so that subsequently the entire upper container part 12 can be lifted as a whole, and the welded and/or glued connection between the circumferential flange 150 of the rim 15 and the lid element 17 is subsequently released. The welded and/or glued connection has been adjusted in such a way that in the course of opening no damage is caused to the circumferential flange 150 of the rim 15 and the lid element 17 as such. If then the upper container part 12 is further lifted by tilting, the connection between the lid element with the circumferential flange is released around the entire container opening 14. After removing the upper container part 12 in its entirety, the product can be removed from the lower container element 11.

If subsequently the lower container part is to be closed again, the upper container part 12 is again placed on the lower container part 11 and they are displaced in the direction of the arrow 27 until the snap-in connection 18 between the projection 180 and the free end of the circumferential flange 150 snaps together. The remaining product in the lower container part 11 can be stored again in the substantially tightly closed container part 11.

If the foil-shaped lid element 11 is made of a material transparent to light, the user of the container 10 can determine the container contents even in the closed state of the container 10, which is of great advantage for purposes of displaying the container contents, for example on shelves or in freezer chest.

What is claimed is:

1. A container for solid or pasty products, as well as for those that are flowable or removable by dipping, comprising a lower container part adapted to receive a product; an upper container part comprising a cover for the container, said lower container part having an opening and a continuous rim extending around the opening; said cover comprising a collar element which extends around the container opening and surrounds the opening and the rim when the cover is attached to the lower container part, and a substantially flat lid element that is fixedly fastened to the collar element and is releasably fastened by glue and/or welding to the rim of the lower container part; said collar element including an outer portion that surrounds the rim, an upper portion connected to the outer portion, and a circumferential wall connected to and extending downwardly from the upper portion toward the rim and oriented with a lower free end thereof facing toward the rim, with the lid element being fastened at said free end along an outer edge of the lid element with the outer edge of the lid element disposed between the free end and the rim.

2. The container in accordance with claim 1, wherein the rim of the lower container part comprises a circumferential outwardly extending flange.

3. The container in accordance with claim 2, wherein the lid element, at least partially covers the rim flange and is releasably fastened thereon.

4. The container in accordance with claim 1, wherein the outer edge of the lid element is fastened on an inner side of the downwardly extending circumferential wall facing away from the lid element.

5. The container in accordance with claim 1, wherein, in relation to an imaginary portion of the lower container part that is arranged to support the lower container part on a surface, the circumferential rim of the lower container part extends substantially parallel with such surface when the lower container part is resting on such surface.

6. The container in accordance with claim 1, wherein the lid element comprises a material similar to a foil.

7. The container in accordance with claim 6, wherein the lid element and the collar element are each separate parts.

8. The container in accordance with claim 1, wherein the lower container part is made in one piece with the rim.

9. The container in accordance with claim 1, wherein the thickness of the lid element lies within the range of 0.1 to 0.3 mm.

10. The container in accordance with claim 1, wherein the outer portion of the collar element has an area comprising a snap-in connection, which extends, and is releasably snapped-in, around and behind the rim.

11. The container in accordance with claim 10, wherein the snap-in connection area of the collar element includes a triangular shaped protrusion directed toward the rim of the lower container part and which, in the closed state of the container, extends under the rim.

12. The container in accordance with claim 1, wherein, upon the fastening between the lid element and the rim being released, the connection between the lid element and the collar element remains intact so that upon removal of the collar and lid element from the lower container part, the lid element separates from the rim and is removed from the lower container part with the collar in a manner such that releasing of the lid element from the rim via the collar results in no damage to the rim.

13. The container in accordance with claim 1, wherein the material of the lower container part and the material of the collar element are identical.

14. A container for solid or pasty products, as well as for those that are flowable or removable by dipping, comprising a lower container part adapted to receive a product; an upper container part comprising a cover for the container, said lower container part having an opening and a continuous rim extending around the opening; said cover comprising a collar element which extends around the container opening and surrounds the opening and the rim when the cover is attached to the lower container part, and a substantially flat lid element that is fixedly fastened to the collar element and is releasably fastened by glue and/or welding to the rim of the lower container part; said collar element including an outer portion that surrounds the rim, an upper portion connected to the upper portion, and a circumferential wall connected to and extending downwardly from the upper portion toward the rim and oriented with a lower free end thereof facing toward the rim, with the lid element being fastened at said free end along an outer edge of the lid element on an outer side of the circumferential wall facing towards the lid element.

* * * * *